United States Patent [19]

Behring

[11] 4,063,944

[45] Dec. 20, 1977

[54] CUPOLA CHARGE MATERIAL

[75] Inventor: James A. Behring, Waukesha, Wis.

[73] Assignee: Grede Foundries, Inc., Milwaukee, Wis.

[21] Appl. No.: 777,434

[22] Filed: Mar. 14, 1977

Related U.S. Application Data

[63] Continuation-in-part of Ser. No. 609,285, Sept. 2, 1975, abandoned.

[51] Int. Cl.[2] ..... B21C 37/00

[52] U.S. Cl. ..... 75/256; 75/44 S

[58] Field of Search ..... 75/256, 44 R, 44 S

[56] References Cited

U.S. PATENT DOCUMENTS

| | | | |
|---|---|---|---|
| 1,075,135 | 10/1913 | Alton | 75/44 S |
| 3,864,092 | 2/1975 | Ravitz | 75/44 S |

FOREIGN PATENT DOCUMENTS

| | | | |
|---|---|---|---|
| 587,480 | 4/1947 | United Kingdom | 75/44 R |

*Primary Examiner*—M. J. Andrews

*Attorney, Agent, or Firm*—Andrus, Sceales, Starke & Sawall

[57] ABSTRACT

A cupola charge material in briquette form composed of 15% to 35% by weight of coke breeze, 0% to 25% of iron oxide, 8% to 20% of cement as a binder, and the balance ferrous metal scrap. The ingredients are mixed with water, poured into a mold of the desired shape and dried to set the cement. The resulting briquette has a density greater than 100 pounds per cubic foot.

6 Claims, No Drawings

CUPOLA CHARGE MATERIAL

This is a continuation-in-part application of Ser. No. 609,285, filed Sept. 2, 1975, now abandoned.

BACKGROUND OF THE INVENTION

The most widely used method of melting iron for foundry practice is through the use of a cupola. With the use of a cupola, coke, a fluxing material such as limestone, and metallic material are charged into the cupola. The coke is ignited and air is introduced into the sides near the bottom of the cupola and blasts upwardly through the burden to generate an intense heat. The molten metal trickles downwardly through the charge and coke bed and is collected in a well at the bottom of the cupola while molten slag composed of coke ash and non-combustible materials floats on the molten metal in the well.

In the production of iron for foundry practice, the metallic charge generally consists of scrap castings and returns, pieces of steel scrap, cast iron scrap, pig iron and ferrous alloy.

The coke as used in the charge is a high quality metallurgical grade produced from low sulfur coal, which is a relatively expensive material. Coke breeze, on the other hand, which consists of fine granular material from coke, is relatively inexpensive and is normally discarded. Coke breeze itself cannot be charged in the cupola since the air blast and intense heat would immediately consume the coke breeze and blow it out of the cupola with little or no heat produced.

Similarly, small particles of metal scrap cannot be charged into the cupola. Small metal particles, as in the case of the coke breeze, would be blown out of the cupola and/or oxidized with little or no resulting yield of molten metal.

SUMMARY OF THE INVENTION

The invention relates to a cupola charge material in briquette form which is composed by weight of 15% to 35% of coke, breeze, 8% to 20% of cement as a binder, 0% to 25% of iron oxide and the balance, small ferrous metal scrap.

The coke breeze consists of small, finely divided, particles of coke having an average particle size less than 1/4 inch. The ferrous scrap particles can be steel or cast iron and generally consists of millings, borings, turnings, chips, etc. from machining operations. The iron oxide, as an optional ingredient, can take the form of mill scale, blast furnace flue dust, basic oxygen process dust, or naturally occurring iron oxides.

In producing the briquette, the coke breeze, ferrous scrap particles, cement, and iron oxide, if used, are mixed together with sufficient water to provide a composition which can be poured into a mold of the desired shape. After molding, the composition is dried to set the cement and provide a bonded briquette or block which can be used as a cupola charge material.

The cupola charge material of the invention utilizes materials which normally could not be employed individually as a cupola charge because of their small particle size. However, by use of the invention, the coke breeze, iron oxide and ferrous particles are bonded together into a relatively dense briquette having a density greater than 100 pounds per cubic foot, and as such, the briquette can be used as a charge material without excessive consumption or oxidation of the coke breeze or the iron particles. Through use of the relatively inexpensive coke breeze, iron oxide, and cast iron scrap particles, materials which are normally discarded, the cost of the charge is substantially reduced.

As a further advantage, the cement, which is used as a binder in the briquette, can replace a portion of the limestone which is normally used as a fluxing material in the cupola charge.

As a further unexpected advantage, the use of the cupola charge material of the invention produces a molten iron which is lower in sulfur content than that produced using conventional charge materials.

Other objects and advantages will appear in the course of the following description.

DESCRIPTION OF THE PREFERRED EMBODIMENT

The invention relates to a cupola charge material in briquette or block form, which, in general, has the following composition in weight percent:

| | |
|---|---|
| Coke Breeze | 15 - 35% |
| Cement | 8 - 20% |
| Iron oxide | 0 - 25% |
| Ferrous Scrap Particles | balance |

The preferred range of composition in weight percent for the cupola charge materials is as follows:

| | |
|---|---|
| Coke breeze | 15 - 25% |
| Cement | 10 - 15% |
| Iron oxide | 10 - 15% |
| Ferrous Scrap Particles | balance |

A specific composition falling within the above range, and without the use of iron oxide, is as follows:

| | |
|---|---|
| Coke breeze | 20% |
| Ferrous Scrap Particles | 68% |
| Cement | 12% |

A specific composition falling within the above range and containing iron oxide is as follows:

| | |
|---|---|
| Coke breeze | 20% |
| Ferrous Scrap Particles | 56% |
| Cement | 12% |
| Iron oxide | 12% |

Coke breeze comprises finely divided particles of high quality metallurgical coke. In general, the coke breeze will have a particle size less than ¼ inch.

The ferrous scrap particles can be steel or cast iron particles, and the ferrous material in combination with the coke breeze, provides a high density block or briquette. The ferrous metal scrap can take the form of millings, turnings, borings, chips, and other particles that results from machining operations or other working operations on ferrous metals. The particles can be of any shape or configuration and, in general, have a maximum dimension of about one inch on a diagonal.

Cast iron scrap particles are preferred, for steel scrap materials, in an unprocessed state, are somewhat more resilient than cast iron particles, and produce a less dense briquette or block. However, the steel scrap particles can be subjected to a crushing operation which acts to reduce the particle size and decrease the resiliency of the particles.

The iron oxide can take various forms, such as mill scale, blast furnace flue dust, basic oxygen process dust, or naturally occuring iron oxide.

The cement, which may be conventional Portland cement, can be used in an amount sufficient to bond the coke breeze and cast iron particles together and provide the resulting block or briquette, and generally in an amount of 8% to 20% by weight of the composition.

In producing the briquetted cupola charge material, the coke breeze, ferrous particles, cement and iron oxide, if used, are mixed together, in the desired proportions with water to provide a flowable mixture. The percentage of water used in the mixture is not critical, but should be sufficient to enable the mixture to be readily cast into the mold of desired shape. The The mold can take any desired form or shape having a maximum dimension of 18 inches for ease of handling.

After the blocks or briquettes have been molded, the blocks are cured in a kiln, using steam for about 4 hours. amd then dried at a temperature up to 160° F for 8 to 15 hours. The resulting bonded briquette has a density in excess of 100 pounds per cubic foot. The use of steam accelerates the cure of the cement, and develops a higher strength briquette in a shorter period of time.

The blocks or briquettes can be used as a cupola charge material for producing iron in foundry practice. Through use of briquettes, the coke breeze, which is normally discarded can be utilized as an energy source, thereby not only providing a substantial conservation of energy, but resulting in a reduction in cost for the charge material. By using coke breeze, it is possible to recover approximately 50% of the normal BTU value of metallurgical coke. For example, for each 2 tons of coke breeze used in briquette form as a charge material, 1 ton of coke can be elminated from the charge.

It is also believed that the coke breeze, being in intimate proximity to the iron particles in the bonded briquette, will tend to prevent oxidation of the iron before breakdown of the briquette in the cupola.

Similarly, the relatively inexpensive small ferrous scrap particles and iron oxide particles, which indivudally could not be employed as a cupola charge, can be utilized in the charge material.

The cement serves as a substitute for a portion of the limestone normally used as a fluxing material in the cupola. Thus, it serves a dual function in acting as both a binder for the briquette and a fluxing agent in the charge.

The cupola charge material of the invention also provides an unexpected advantage in producing molten iron that has a lower sulfur content than that produced using conventional charge materials. The precise mechanism by which the sulfur content of the molten iron is reduced is not completely understood, but it is believed that due to the change in the slag chemistry, as a result of adding cement, the slag becomes more "basic". Basic slag will absorb more sulfur than an acid slag in cupola melting.

The following example illustrates the method of preparing the briquettes or blocks:

A dry mixture was prepared containing 3450 lbs. of cast iron borings, 650 lbs. of coke breeze and 750 lbs. of Portland cement. Sufficient water was added to the mixture to render it flowable.

The mixture was cast into approximately 60 blocks or slabs having a size of approximately 4× x 8× x 16×. In the green state, after molding, the blocks were rigid and stable and showed no evidence of crumbling.

The blocks were then cured in a kiln using steam for a period of about 4 hours, and then dried at a temperature of about 160° F for 10 hours.

The blocks were tested to determine the breaking load for fracture, and the breaking load averaged 60,750 lbs. for blocks tested on edge and 143,750 lbs. for blocks tested flat.

Various modes of carrying out the invention are contemplated as being within the scope of the following claims particularly pointing out and distinctly claiming the subject matter which is regarded as the invention.

I claim:

1. A cupola charge material, comprising a bonded block composed of 15% to 35% by weight of coke breeze, 8% to 20% by weight of cement, 0% to 25% of iron oxide, and the balance being ferrous metal scrap.

2. The cupola charge material of claim 1, wherein said ferrous scrap is iron scrap.

3. The cupola charge material of claim 1, wherein said block has a density greater than 100 pounds per cubic foot.

4. The cupola charge material of claim 1, wherein the iron oxide is mill scale.

5. The cupola charge material of claim 1, wherein said ferrous scrap material has a maximum dimension of about 1 inch and is derived from machining operations.

6. A cupola charge material, comprising a bonded briquette composed of 15% to 25% by weight of coke breeze having a particle size less than ¼inch, 10% to 15% by weight of cement, 10% to 15% by weight of iron oxide, and the balance being ferrous scrap particles having a maximum dimension of about 1 inch and consisting of the residue from machining operations, said briquette having a density greater than 100 pounds per cubic foot.

* * * * *

UNITED STATES PATENT AND TRADEMARK OFFICE

CERTIFICATE OF CORRECTION

PATENT NO. : 4,063,944

DATED : December 20, 1977

INVENTOR(S) : JAMES A. BEHRING

It is certified that error appears in the above-identified patent and that said Letters Patent are hereby corrected as shown below:

Column 4, Line 15, Cancel "4X x 8X x 16X" and substitute therefor ---4" x 8" x 16"---

Signed and Sealed this

*Twenty-fourth* Day of *October 1978*

[SEAL]

*Attest:*

RUTH C. MASON
*Attesting Officer*

DONALD W. BANNER
*Commissioner of Patents and Trademarks*